US005609294A

United States Patent [19]

Lucas, Jr.

[11] Patent Number: 5,609,294

[45] Date of Patent: Mar. 11, 1997

[54] RAILROAD TRACK ASSEMBLY AND METHOD

[76] Inventor: Joseph Lucas, Jr., 25023 NW. Oak Island Rd., Portland, Oreg. 97231

[21] Appl. No.: 505,381

[22] Filed: Jul. 21, 1995

[51] Int. Cl.[6] ..... P01B 1/00

[52] U.S. Cl. ..... 238/9; 238/6; 238/8

[58] Field of Search ..... 238/3, 6, 8, 9

[56] References Cited

U.S. PATENT DOCUMENTS

| | | | |
|---|---|---|---|
| 1,038,982 | 9/1912 | Starke . | |
| 1,230,058 | 6/1917 | Wooldridge . | |
| 1,244,010 | 10/1917 | Anderson . | |
| 2,950,057 | 8/1960 | Speer | 238/8 |
| 3,056,555 | 10/1962 | Eisses | 238/8 |
| 3,353,747 | 11/1967 | Speer | 228/8 |
| 3,469,783 | 9/1969 | Uralli et al. | 238/8 |
| 4,606,498 | 8/1986 | Grant et al. | 238/8 |
| 4,793,545 | 12/1988 | Raymond | 238/8 |
| 4,899,933 | 2/1990 | Martin | 238/8 |
| 5,181,657 | 1/1993 | Davis | 238/8 |

FOREIGN PATENT DOCUMENTS

| | | |
|---|---|---|
| 171856 | 7/1952 | Australia . |
| 172157 | 8/1952 | Australia . |
| DD 258-035-A | 7/1988 | German Dem. Rep. . |
| 463128 | 4/1951 | Italy . |

OTHER PUBLICATIONS

TriMet Drawing C4C1688 Revision A, dated Jul. 15, 1994, West Side Corridor Project, Line Section 4C, Track Section Brick Pavers.

TriMet Drawing C4C177 Revision 00, dated Mar. 25, 1994, West Side Corridor Project, Line Section 4C, 50 Meter Single Crossover, 14'–3" Track Centers.

Pacific Design Engineering Drawing for Protective Cap, Revision 2, dated Oct. 13, 1994.

*Primary Examiner*—S. Joseph Morano

*Attorney, Agent, or Firm*—Chernoff, Vilhauer, McClung & Stenzel

[57] ABSTRACT

A structural arrangement for an embedded and sealed railroad track and a method for its installation to provide a gutter defined along the rails of such a railroad track extending along or across a street or highway with rail tops at pavement level. Rubber filler bodies are held in place along the sides of each rail by retainer strips which lock into place on the filler bodies. A retainer form holds the filler bodies in place and provides space for the retainer strips when pavement materials are cast in place along the rails. Protective caps and sealing structures are installed before pavement materials are cast in place, to exclude the paving materials from space needed as a gutter along the rails to provide access to the rails and to spaced-apart supporting structures to which the rails are fastened, and to keep foreign materials from getting on the top of the rails and prevent them from becoming caught between the rails and the adjacent filler bodies.

24 Claims, 5 Drawing Sheets

RAILROAD TRACK ASSEMBLY AND METHOD

BACKGROUND OF THE INVENTION

The present invention relates to construction of railroad tracks, and particularly to the construction of railroad tracks embedded into the surface of a street or highway where automobile traffic will also travel, as at railway grade crossings and on streets where ligh-trail mass transport trains are operated.

Construction of railroad tracks along streets or across streets or highways has long presented the problem of how to present a minimum amount of unevenness to be encountered by motor vehicles operating on a pavement surface of such streets or highways. Additionally, if trains to be operated on such tracks are electrically powered, the track and its foundations are constructed to isolate the rails electrically.

If an open channel is left alongside a rail, entry of dirt and water can result in significant problems where railroad tracks run along a street and there is no ready path for drainage beneath the track. Various arrangements have been known in the past for providing a closed sealing structure around rails, particularly those rails which include a channel for receiving a flange of a car wheel, but such structural arrangements have previously been unnecessarily complex and undesirably costly.

It has been known in the past to install rubber filler bodies in place as seals along the rails of a track, and to place spacers alongside the seals after pavement has been constructed with the use of conventional masonry forms along the entire extent of the railway along or across streets and highways. Sealing material such as asphalt or the like has then been placed atop the spacers. Installation of such sealing material requires a considerable amount of labor, and such spacers and sealing material are somewhat lacking in ability to provide lateral support for the filler bodies. A considerable amount of labor is also required to remove such sealing material and spacers when it becomes necessary to remove the rubber filler bodies in order to repair the rails.

Austrian Patent No. 172157 discloses filler bodies associated with a railroad track rail set into a pavement, but shows no provision for fasteners attaching such a track rail to a supporting structure below pavement surface level.

Raymond U.S. Pat. No. 4,793,545 discloses sealing insert assemblies which extend along the length of the rails of an embedded track, but which appear likely to be costly to construct and yet unable to provide access to the rail support structure for repair.

Davis U.S. Pat. No. 5,181,657 discloses a grade crossing system including elastomeric pad units located along each side of the rails for supporting automobile traffic crossing railroad tracks. The disclosed structure, however, requires specially pre-cast panels which rest on the pads, making such structure undesirably expensive for use along a railway track embedded in a paved street.

Martin U.S. Pat. No. 4,899,933 discloses a railway crossing seal system which utilizes specially shaped pre-formed concrete planks on each side of a rail to retain rubber seal bodies. The structure taught by Martin thus appears likely to be excessively expensive for use over an extended distance along a railroad track embedded in a street.

Where tracks are embedded in pavement it is necessary to have a gutter to contain each rail, yet it must also be possible to gain access to the rail, its supporting structures, and fasteners attaching the rail to such supporting structures. Previously known protective caps intended to provide cavities around spaced-apart structures supporting the rails have been quite costly. Nevertheless, their use has not avoided the need for significant amounts of labor during the construction of an embedded railroad track, in order to provide support for pavement alongside each rail of a track, since a certain amount of space must be provided on each side of each rail to accommodate movements of the rails resulting from thermal expansion and contraction and from the loads imposed by the weight and movement of cars carried on the tracks.

Additionally, in order to avoid undesired unevenness of the surface of a street across or along which a railroad track runs, it is desirable that the pavement surface be approximately level with the height of the top of the rails of the track and that appropriate resilient filler structure be provided between the pavement and each rail to support motor vehicle traffic. Such filler structures, moreover, must not interfere with passage of railroad cars along the track.

What is desired, then, is an improved structure for railroad tracks embedded in a roadway, and a corresponding method for construction of such embedded railroad tracks and surrounding roadway pavement, which is easier and less costly than previously used methods and structures yet can provide long-lasting serviceability, while still giving needed access to the rails and supporting structures at lesser expense than has previously been possible.

SUMMARY OF THE INVENTION

The present invention overcomes the aforementioned shortcomings and disadvantages of the prior art and provides an improved structure for protectively sealing the spaces along the top of a rail of an embedded railroad track while also providing structural support in the space between the rail and adjacent paving material, as well as providing a method of constructing a railroad incorporating such a sealing structure.

A railroad track according to the present invention is embedded in a street or highway structure with the top of each rail located at about the same level as the top surface of the pavement, with each rail supported on supporting structures resting on a foundation located beneath the level of the pavement. The supporting structures are spaced apart longitudinally of each rail and the rails are attached to the supporting structures, as by conventional spring clips. Sealing filler bodies of rubber or rubber-like plastic material are located on each side of the rail, where they are held in place against the rail by retainer strips which interlockingly engage the filler bodies to present a top surface level with the pavement on either side of the rail. Inexpensive closure structures are fastened to the foundation along either side of the rail and extend into contact with the filler bodies so that paving materials such as concrete or mortar can be poured against the closure structures, leaving a gutter of required size to house the rail and leave it accessible for maintenance and repairs. Located adjacent each of the supporting structures spaced apart along the length of each rail is a protective cap of metal having a vertical side, a sloping top, and an upper margin which rests against the adjacent one of the sealing filler bodies. An end closure fits snugly beneath each end of the protective cap to exclude mortar or concrete from a cavity defined by the protective cap to enclose the fasteners attaching the rail to the support structure.

In one embodiment of the invention the protective cap mentioned above is of galvanized sheet steel and is attached to the foundation for the railroad track simply by the use of fasteners such as explosively-driven masonry nails.

A feature of one embodiment of the invention is a retainer strip that mates lockingly with the adjacent face of one of the filler bodies, with a tongue-and-groove arrangement, to prevent the retaining strip from working upwardly out of a slot alongside the filler body, between the filler body and adjacent pavement of the street in which the railroad track is embedded.

A feature of one embodiment of the invention is that the protective caps are easily formed as lengths of a longitudinally-extending sheet metal structure, and end closures for the protective cap are easily die cut from sheets of suitably dense sponge rubber or similar material.

According to the method of the present invention, the sealing filler bodies are placed alongside the rails after the rails have been fastened to the supporting structures. Longitudinal closure members are then attached to the track bed foundation between the spaced-apart supporting structures to which the rails are attached. The protective caps previously mentioned are placed alongside the respective sealing filler bodies, in position to protectively shield the spaced-apart supporting structures, and the end closures are placed into the ends of the protective caps. A retainer form is placed over the top of the rail and the filler bodies, holding the filler bodies in place closely alongside the rail. Concrete, mortar or other paving material is placed alongside the rail structure, including the retainer form, whose depending legs act as a form for the paving material to define a slot alongside the filler bodies. When the paving material has hardened, the retainer form is removed from atop the rail and filler bodies and the retainer strips are forced into the slot and mate lockingly with the filler body.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
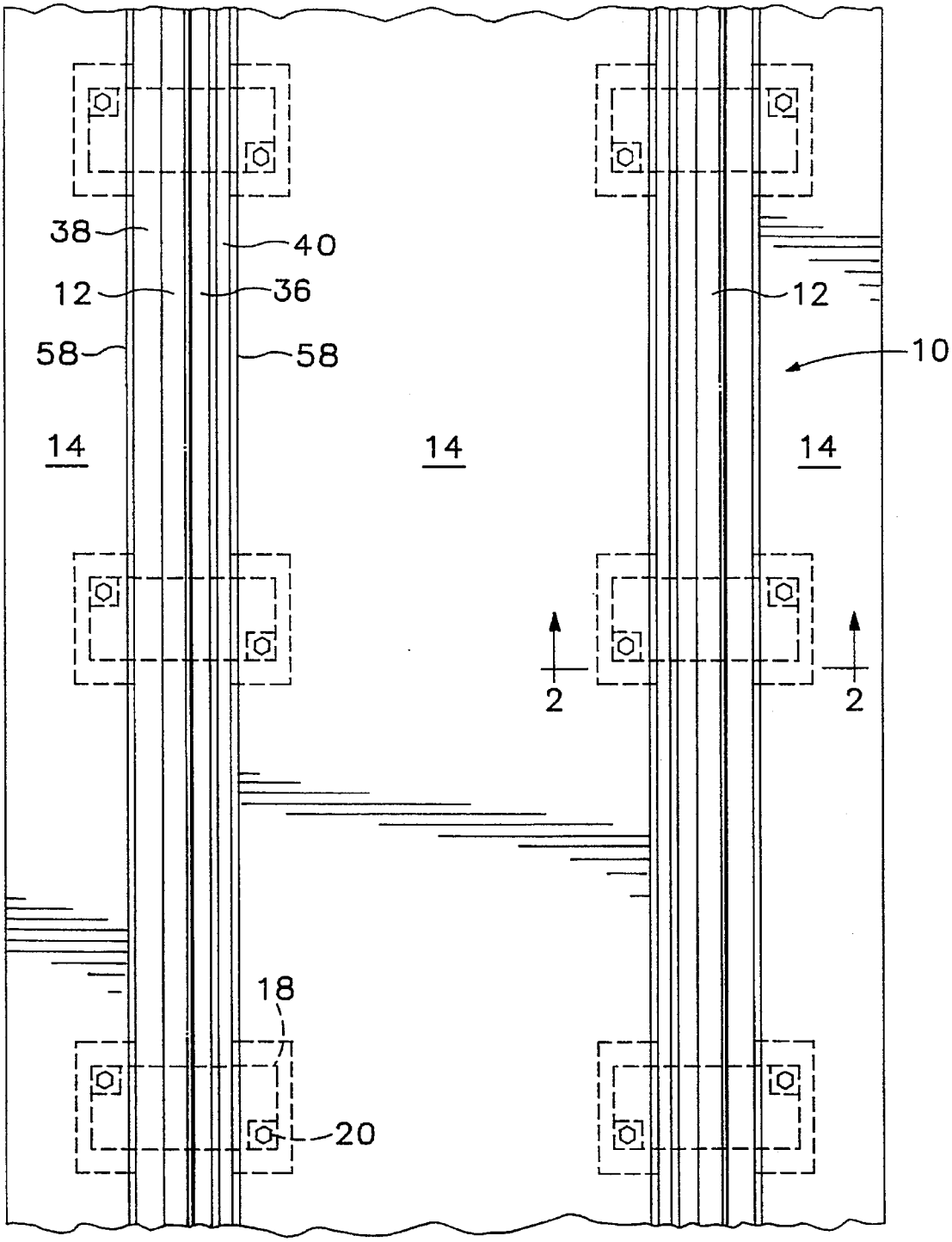
FIG. 1 is a top plan view of a portion of a railroad track constructed according to the present invention.

Referring now to FIG. 1 of the drawings which form a part of the disclosure herein, a railroad track 10 including a pair of parallel rails 12 is shown embedded in a paved surface 14 such as a city street in which the track 10 is provided for use by light-rail passenger cars. Because the paved surface 14 also serves to carry automobile traffic, it is desirable to have the light-rail track 10 cause a minimum amount of unevenness in the paved surface 14.

Although the rails 12 are fastened in place as part of the track 10, a certain amount of movement must be possible, in order to accommodate thermal expansion and contraction and to distribute the loads imposed on the track 10, both by train cars traveling along the track 10 and by automobile traffic along the pavement into which the track 10 is recessed. It is also necessary from time to time to remove portions of the rails 12, as when they have become worn through long use, and so it is important to be able to gain access to the rails 12 without having to break up the adjacent pavement.

Figure 2:
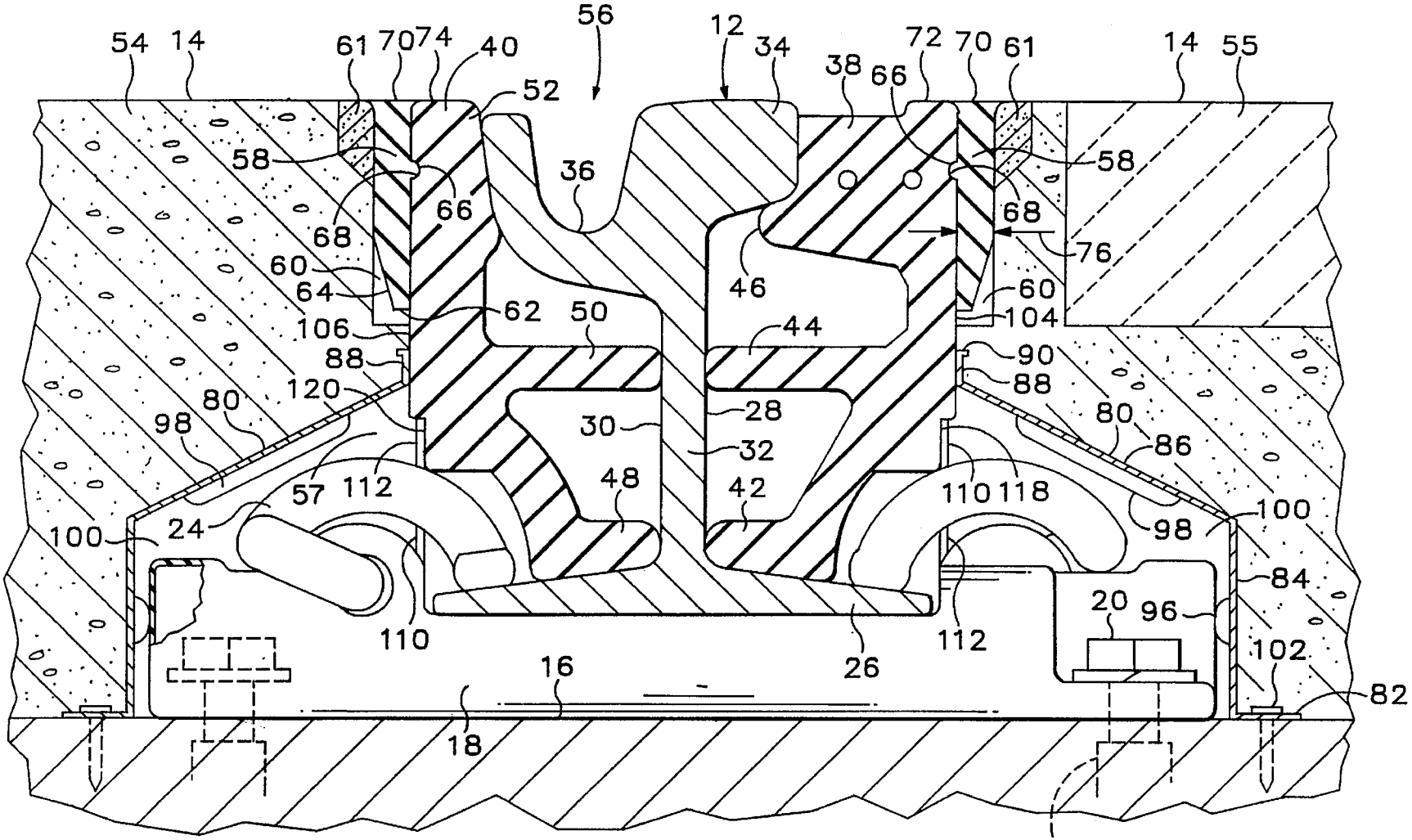
FIG. 2 is a section view of a part of the railroad track shown in FIG. 1, taken along line 2—2 at an enlarged scale and showing a pair of protective caps embodying a part of the present invention.

As shown in FIG. 2, the track 10 includes a foundation 16, which may be a precast concrete slab appropriately set into place, and on which pandrel plates 18 are fixed in place by suitable fasteners such as holddown bolts 20 mated with appropriate threaded receptacles 22 fixed in the foundation 16. The pandrel plates 18 are located at regular intervals along each of the rails 12, ordinarily being in pairs supporting the rails 12 of the track at opposite locations. The pandrel plates 18 receive spring clips 24 which press down upon respective sides of a base flange 26 of the rail 12 on both the outer side 28 and the opposite inner side 30 of the rail 12.

A web 32 of the rail extends vertically above the middle of the flange 26 and supports a head portion 34 of the rail 12. In the rail 12 shown in the drawings herein, the head 34 defines a channel 36 to receive the flange of a wheel of a railroad car (not shown) as it travels along the track 10.

In accordance with the present invention, a pair of sealing filler bodies, an outside filler body 38 and an inside filler body 40, rest, respectively, against the outer side 28 and inner side 30 of the rail 12 with a bottom portion or foot 42 of the outside filler body 38 resting atop the flange 26, a central rib 44 resting against the web 32, and an upper portion 46 of the outside filler body 38 resting against the head 34 on the outer side 28 of the rail 12, as shown in FIG. 2.

Similarly, a foot 48 of the inside filler body 40 rests atop the flange 26 on the inner side 30 of the rail 12, with a central rib 50 resting against the web 32, and an upper portion 52 resting against the head 34 of the rail 12 adjacent the channel 36. The filler bodies 38 and 40, and particularly the upper portions 46 and 52 thereof, provide a seal against the surfaces of the head 34 of the rail 12 to prevent or limit intrusion of rain water and street dirt alongside the rail 12. The filler bodies 38 and 40 also provide electrical insulation of the rail 12 in a track 10 for electrically-powered cars, as in a light-rail public passenger transit system.

Each of the filler bodies 38 and 40 is of an elastomeric material, such as an extruded thermoplastic, synthetic rubber in lengths short enough to be handled conveniently, such as 21 feet long. Such a material which is satisfactory is a mixture consisting primarily of polypropylene and EPDM, available from Advanced Elastomer Systems of Akron, Ohio under the trademark SANTOPRENE in a durometer hardness of 70, providing sufficient strength for this use, as well as sufficient flexibility and elasticity.

As may be seen best in FIG. 2, a body of paving material 54, which may include a paving stone 55, rests atop the foundation 16 and defines a gutter 56 within which are located the rail 12 and the filler bodies 38 and 40, as well as the spaced-apart pandrel plates 18 on which each rail 12 is supported. Cavities 57 are defined around the pandrel plates, as will be explained subsequently in greater detail. Near the top of the gutter 56, a respective retainer wedge or strip 58 is located on each side of the rail 12 within a respective slot 60 defined between a portion 61 of the paving material 54 and the adjacent one of the filler bodies 38 and 40. As will be explained below, the portion 61 of the paving material 54 may be of a grout material of somewhat different quality than ordinary paving concrete. The retainer strip 58 is of an elastomeric material and may be several feet long.

Each retainer strip 58 has a tapered lower margin 62, defined by a beveled side 64 facing away from the associated filler body 38 or 40. On the inner side of the retainer strip, the side facing toward the respective filler body 38 or 40, a tongue 66 protrudes laterally and extends longitudinally of the retainer strip 58, which as with the filler bodies 38 and 40, may be of extruded thermoplastic synthetic rubber material such as SANTOPRENE™.

The tongue 66 is received matingly within a corresponding groove 68 defined in the outer side, the side facing away from the rail 12, of each of the filler bodies 38 and 40, securely holding the retainer strip 58 to prevent it from inadvertently working itself up from the slot 60, so that an upper surface 70 of the retainer strip 58 is aligned, respectively, with an adjacent upper surface 72 of the outside filler body 38 or with an upper surface 74 of the inside filler body 40. The retainer strip 58 has a thickness 76 great enough so that when it is located in the slot 60 the retainer strip 58 and the respective one of the filler bodies 38 and 40 are both elastically compressed between the adjacent portion 61 of the paving material 54 and the adjacent portion of the head 34 of the rail 12, in order to maintain a tight seal along the head of the rail 12 to exclude water and dirt from the gutter 56. Preferably, the top of the retainer strip 58 is flared to fit the respective filler body 38 or 40 and the top of the grout 61 defining the slot 60.

Figure 3:
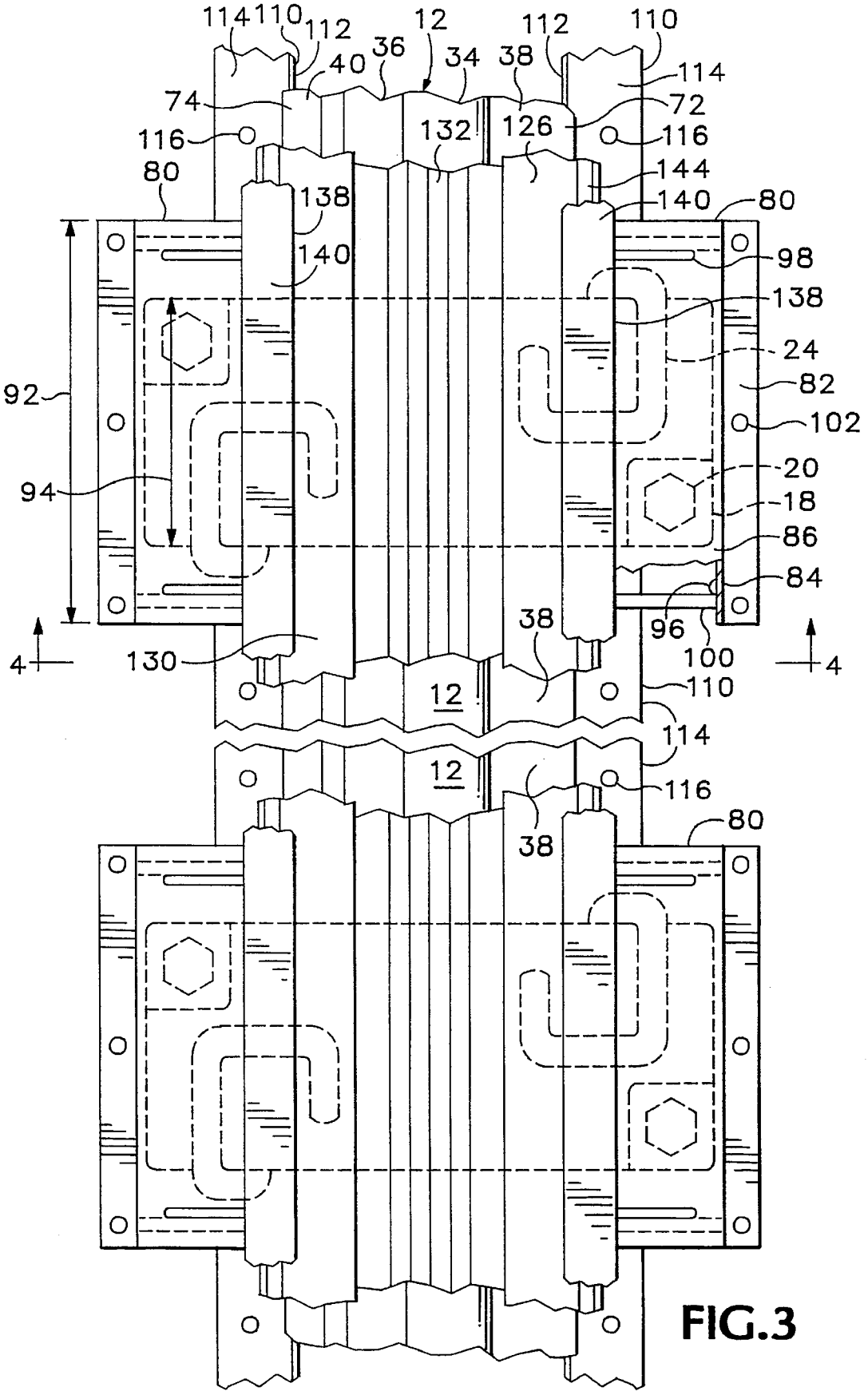
FIG. 3 is a partially cut-away top plan view of one rail of the railroad track assembly shown in FIG. 1, at an enlarged scale and without paving material, showing such a railroad track at one stage in the process of its construction in accordance with the present invention.

Referring now also to FIG. 3, where a portion of the rail 12 is shown without the paving material 54, a protective cap 80 has a lower margin 82, an upstanding side 84, a diagonally upwardly-sloping top 86, and a vertical upper margin 88 which preferably includes an outwardly-extending narrow horizontal flange 90. The protective cap 80 is preferably made of sheet metal, such as hot dip galvanized sheet steel, and has a length 92 somewhat greater than the length 94 of a pandrel plate 18, as measured parallel with the length of the rail 12. Elongate dimples 96 and 98 are located respectively on the side 84 and top 86 of the cap 80, near each end of the protective cap 80. The dimples 96 and 98 protrude inwardly, toward the pandrel plate 18, and help to provide lateral support for a respective end closure piece 100 associated with each end of the protective cap 80. The end closure pieces 100 may be of an inexpensive material such as synthetic sponge rubber substantial enough to be self-supporting and to close the space beneath the protective cap 80. The end closure pieces are spaced a small distance away from the adjacent end surface of the pandrel plate 18 over which the protective cap 80 is located, and rest against and are supported by the dimples 96 and 98 protruding inwardly from the protective cap 80, as well as preferably being compressed slightly beneath the protective cap 80 to fit snugly.

To shelter a respective one of the pandrel plates 18 the protective cap 80 is held in place by suitable fasteners, for example explosively-driven masonry nails 102 driven into the foundation 16, preferably through pre-drilled holes (not shown) defined in the lower flange 82. The protective cap 80 is located close enough to the pandrel plate 18 so that the upper margin 88 of the protective cap 80 fits snugly against the outwardly-facing vertical surface 104 of the outside filler body 38 or a corresponding vertical surface 106 of the inside filler body 40. As a result, when the filler bodies 38 and 40 are compressed downwardly, as by the weight of a motor vehicle crossing the track 10, the vertical surface 104 or 106 is able to move vertically a small distance with respect to the upper margin 88.

Extending longitudinally of the rail 12 in each space between adjacent ones of the pandrel plates 18 is a respective elongate closure member in the form of an angle-shaped seal member 110 which may be of an easily formed plastic such as PVC. The seal member 110 extends from the vertical end surface of one pandrel plate 18 to the facing vertical end surface of the next pandrel plate 18. The angle-shaped seal members 110 preferably have the form of elongate L-shaped angle stock having an upright wall portion 112 and a horizontal base portion 114 fastened to the foundation 16 by suitable fasteners such as explosively-driven masonry nails 116. On straight track the pandrel plates 18 are ordinarily spaced apart from each other by a standard distance, so that the elongate closure members 110 can be made in standard lengths which are ready for installation without further preparation. The upright wall 112 is spaced apart a slight distance from the base flange 26 of the rail 12, and its upper margin rests against a respective vertical face 118 or 120 of the outside filler body 38 or inside filler body 40. Each of the vertical faces 118 and 120 is offset inwardly toward the rail 12 from the respective vertical surface 104 or 106 of the filler body 38 or 40, so that a protective overhanging portion of the respective filler body 38 or 40 extends above the upper margin of the upright wall 112.

Each end closure piece 100 has a bottom margin which is preferably cut away to accommodate the horizontal base portion 114 of the plastic angle seal strips 110, so that in combination the protective caps 80, the end closure pieces 100, and the plastic seal strip elongate closure members 110 exclude the paving material 54 from the lower portion of the gutter 56 during its construction.

In constructing a railroad track 10 according to the method of the present invention, the foundation 16 is laid in place atop suitable supporting materials or structure, including, if necessary, an electrical isolation membrane (not shown), and pandrel plates 18 are attached to the foundation 16 as by the use of hold-down bolts 20. The rails 12 are attached to the pandrel plates 18 by the appropriate spring clips 24.

Next, the filler bodies 38 and 40 are placed, respectively, against the outer side 28 and inner side 30 of the rail 12.

Once the filler bodies 38 and 40 have been placed along the respective sides of the rail 12, the angle-shaped seal members 110 are placed on the foundation 16 with the upright wall 112 of each resting against the vertical face 118 or 120 of the respective filler body 38 or 40, and fasteners such as the masonry nails 116 are fitted to retain the seal members 110 in place alongside the base flange 26 of the rail 12 between the pandrel plates 18 on each side of the rail 12.

Next, a protective cap 80 is placed in the position previously described alongside each pandrel plate 18, on each side of the rail 12, protecting the pandrel plates 18 and the spring clips 24. The protective caps 80 are secured to the foundation 16 by installing suitable fasteners such as the masonry nails 102, with each of the protective caps 80 overlapping the ends of a pair of the elongate angle-shaped seal members 110 which extend near the pandrel plate 18 with which the protective cap 80 is associated. A respective end closure piece 100 is placed under the protective cap 80 against the dimples 96 and 98 at each of the opposite ends of the protective cap 80. Each closure piece 100 rests atop the horizontal base 114 of the adjacent elongate seal member 110 and completes a retaining enclosure defining a cavity as part of the gutter 56 surrounding the rail 12 and pandrel plates 18.

Figure 4:
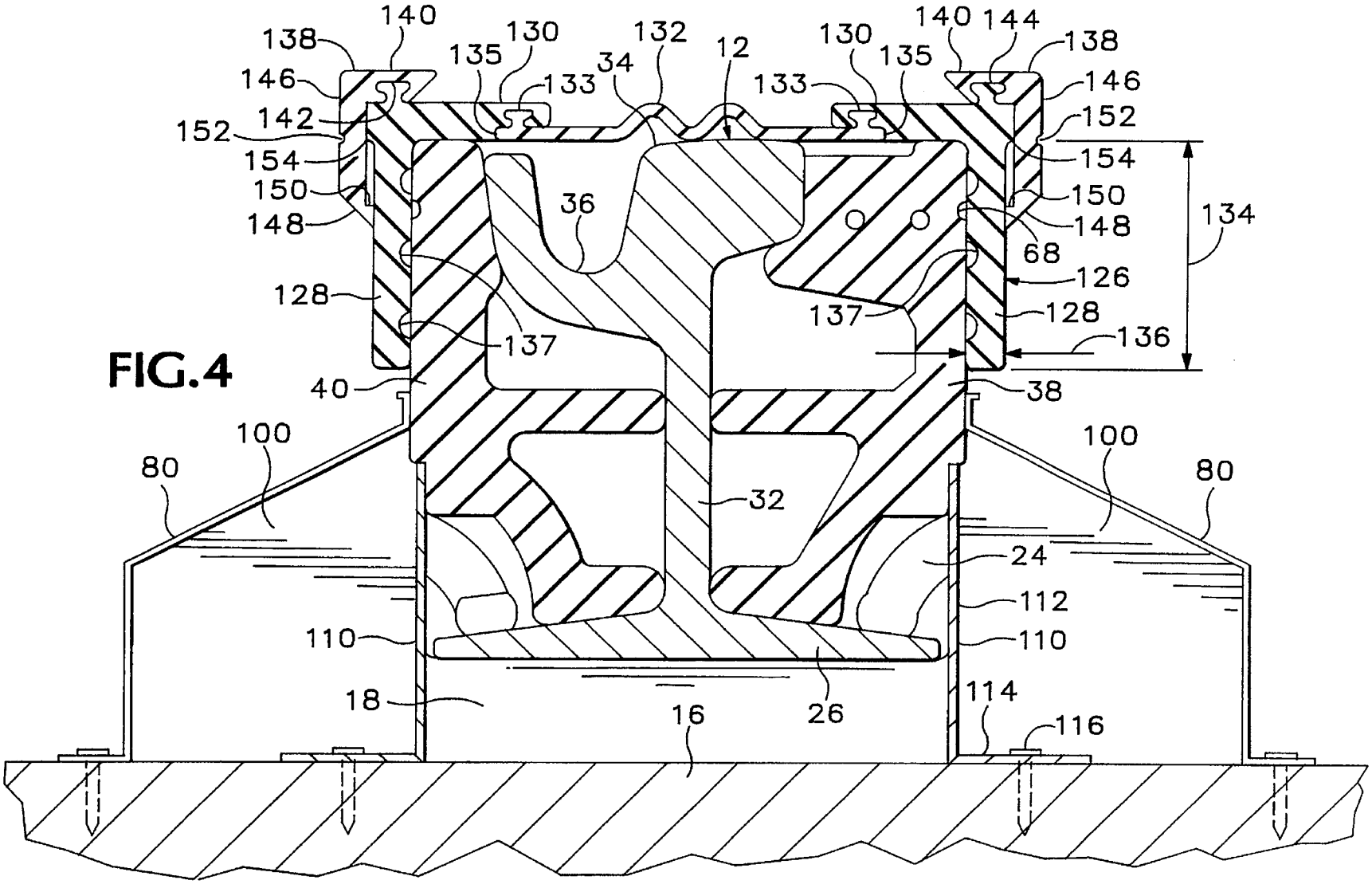
FIG. 4 is a section view taken along line 4—4 of FIG. 3.
Figure 5:
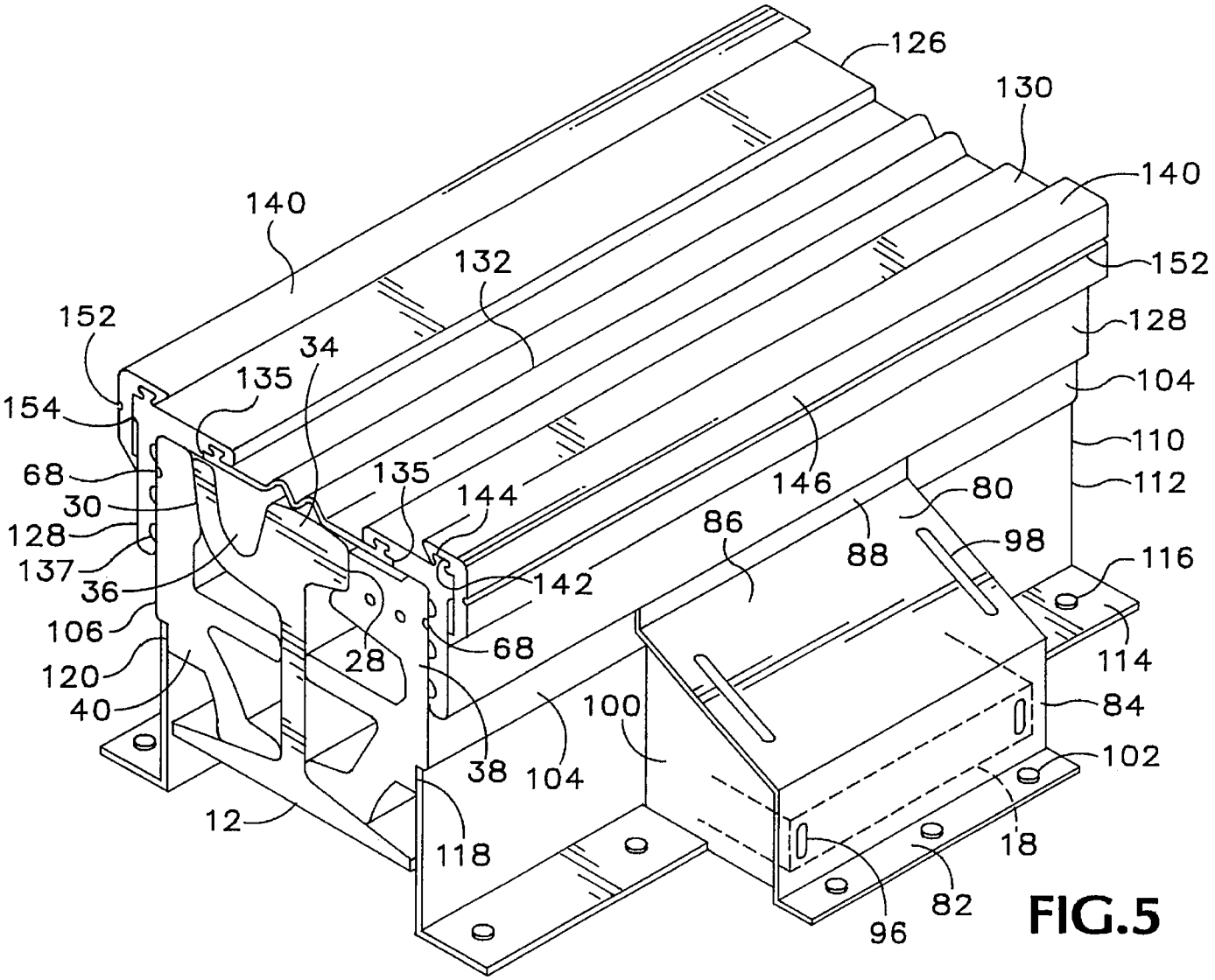
FIG. 5 is an isometric view of a short length of one rail of the track shown in FIG. 3.

A retainer form 126, shown in FIGS. 3, 4, and 5, is then fitted over the rail 12 and the filler bodies 38 and 40 to hold the filler bodies 38 and 40 in place against the head 34 of the rail 12. The retainer form 126 is preferably of extended thermoplastic rubber and resembles an inverted elongate trough having a pair of depending side members 128 and a horizontal top member 130 which includes an expansible center strip 132 of thinner construction and of a corrugated section shape. Preferably, the center strip 132 is separately extruded of a somewhat softer and more elastic material and is joined to the two lateral portions of the retainer form 126 by rounded modified dovetail joints 133, and is also welded to the lateral portions along margins 135 of the center strip 132. Each of the depending side members 128 has a depth 134 and a thickness 136 to equal the depth and width of the slot 60 defining the upper portion of each side of the gutter 56. Large grooves 137 on the inner face of each side member 128 allow the side members to conform more easily to the filler bodies 38 or 40, as where the rails are curved, to create a slot 60 consistently of the desired width along its length.

The top member 130 must be expanded laterally by flexure of the center strip 132 to allow the retainer form 126 to fit over the rail 12 and accompanying filler bodies 38 and 40. The restorative elastic force of the center strip 132 then holds the filler bodies 38 and 40 in place along the rail 12 during succeeding steps of construction.

Preferably, attached to each side of the retainer form 126 is a respective masonry blocking body 138 which fits alongside the respective side member 128 of the retainer form 126 as shown in FIGS. 4 and 5. The blocking bodies 138 are also preferably extruded elongate pieces of thermoplastic rubber similar to that of which the retainer form 126 is made.

A top portion 140 extends generally horizontally across a portion of the top member 130 and includes a locking channel 142 which engages a locking rail 144 which is part of the top member 130, forming a rounded modified dovetail type connection of the blocking body 138 to the retainer form 126. A vertically-extending side portion 146 of the blocking body 138 extends downward alongside the respective side member 128, with a beveled lower margin 148 and a horizontal lip portion 150 fitting tightly against the side member 128. The lip portion is small enough, however, to be removed around the outwardly protruding margin of the top portion 140. The blocking body 138 is thus securely, yet removably, attached to the retainer form 126 to form a plug to keep out paving material to be poured along the track 10.

When this has been done on each rail 12 of the track 10 over a suitable length, paving material can be poured against the exposed surfaces of the elongate seal members 110, the end closure pieces 100, and the protective cap 80 and alongside the depending side members 128 of the retainer form 126 up to the appropriate height for the paved surface 14.

Referring to FIG. 2, it will be understood that in some cases it may be desired to pour the paving material 54 in the form of concrete up to a certain level and thereafter to set paving stones 55 or bricks in place, leaving space for grout 61 to be cast around the depending side members 128 of the retainer form 126.

When, as in most cases, a quantity of grout 61 will be used to define the slot 60 on each side of the rail 12, a quantity of paving material, which may be in the form of concrete or ordinary mortar, is placed along-side the retainer form 126 and the attached blocking body 138 up to the desired height, corresponding generally with the height of the top of the rail head 34, as indicated by a groove 152 in each blocking body 138. Once the paving material has cured to a sufficiently strong condition, the blocking bodies 138 are released from the top portion by flexing the top 140 of the blocking body 140 to disengage the locking channel 142 from the locking rail 144, and the blocking body 138 is then removed from alongside the respective side member 128. The retainer form 126 is left in place atop the rail and alongside the filler bodies 38 and 40. Grout 61 is then placed in the space previously occupied by the blocking body 138 up to the level of the corner 154 of the top portion 130 of the retainer form 126, also at the height of the top of the rail head 34. The boundaries of the grout are thus established by the shape of the side members 128 of the retainer form 126, to define the slots 60 on either side of the rail 12.

When the paving material 54, including grout 61, if used, has cured alongside it, the retainer form 126 is removed from atop the rail 12, leaving a slot 60 formed on each side of the rail 12 alongside the respective one of the filler bodies 38 and 40, and installation of the track 10 can then be completed by forcing a retainer strip 58 downward into the slot 60 on each side of the rail 12 until the respective tongues 66 mate in the grooves 68 defined by the filler bodies 38 and 40, locking the retainer strips 58 in place.

Utilizing the filler bodies 38 and 40 and the retainer form 126 according to the present invention, together with the elongate seal members 110, protective caps 80 and end closure pieces 100, formation of a gutter 56 along railroad track 10 under construction is greatly simplified by comparison with the prior art, particularly in the vicinity of curved track sections, since the extruded filler bodies 38 and 40, made of thermoplastic rubber, can be bent to conform with the curvature of the track rail 12, as can the retainer form 126.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A railroad track assembly, comprising:

(a) a track foundation located below grade level of a paving structure located adjacent said track assembly;

(b) a plurality of rail support bodies spaced apart from one another on said track foundation;

(c) an elongate rail having a pair of opposite sides and including a base flange resting atop said plurality of rail support bodies, a web extending upwardly from said base flange, and a head located atop said web;

(d) a plurality of attachment devices fastening said rail to said rail support bodies;

(e) a pair of preformed elastomeric filler bodies each located alongside a respective one of said opposite sides of said rail and in contact with said base flange, said web, and said head of said rail; and (f) a cap resting on said foundation adjacent a respective one of said rail support bodies and defining a cavity over said attachment device of a respective one of said rail support bodies, said cap having an upper margin thereof resting against a respective one of said filler bodies, and said cap also including a lower margin fastened to said foundation, a side extending upward from said lower margin, and a top extending diagonally upward from said side toward said filler body.

2. The railroad track assembly of claim 1, further including a preformed retainer strip of elastomeric material located in a slot alongside said rail, said retainer strip being in contact with one of said filler bodies, urging said one of said filler bodies toward said side of said rail.

3. The railroad track assembly of claim 1, including a pair of upright end closure pieces associated with said cap and helping to define said cavity.

4. The railroad track assembly of claim 3 wherein said cap extends longitudinally along said rail and has an end located a first distance beyond said respective one of said rail support bodies, and wherein said end closure piece is located spaced inwardly from said end a second distance toward said respective one of said rail support bodies.

5. The railroad track assembly of claim 1, further including an elongate closure member extending along said rail from one of said rail support bodies to a next one thereof, said elongate closure member having an upright wall portion abutting against a respective one of said filler bodies and extending downward therefrom at least as far as said base flange of said rail.

6. The railroad track assembly of claim 5 wherein said elongate closure member has a horizontal base flange resting on and fastened to said track foundation between a pair of said rail support bodies.

7. A railroad track assembly, comprising:

(a) an elongate rail having a pair of opposite sides and including a base flange, a web extending upward from said base flange, and a head located atop said web;

(b) a pair of preformed elastomeric filler bodies each located closely alongside a respective one of said opposite sides of said rail;

(c) a paving structure located alongside one of said opposite sides of said rail at a predetermined distance therefrom and defining, cooperatively with a respective one of said filler bodies, a slot extending alongside said rail; and (d) a preformed retainer strip of resilient material filling said slot and holding said respective filler body in a predetermined position alongside said rail, said retainer strip and said filler body including mating locking structures which are mutually engaged when said retainer strip is located properly in said slot.

8. The railroad track assembly of claim 7 wherein said locking structures include a tongue located on said retainer strip and a groove located on said filler body to receive said tongue when said retainer strip is located properly in said slot.

9. A railroad track assembly, comprising:

(a) an elongate rail having a pair of opposite sides and including a base flange, a web extending upward from said base flange, and a head located atop said web;

(b) a pair of preformed elastomeric filler bodies each located closely alongside a respective one of said opposite sides of said rail and including a respective outer face; and (c) a retainer form including a top member and a pair of depending side members spaced apart from each other and resting against said outer face of a respective ones of said filler bodies with each said filler body resting snugly in position against a respective one of said opposite sides of said rail during construction of a paving structure alongside said rail.

10. The railroad track assembly of claim 9 wherein said retainer form has the general shape of an inverted U-shaped shallow, elongate, open-ended trough.

11. The railroad track assembly of claim 10 wherein each of said depending side members of said retainer form has a predetermined size and shape to define a slot between said respective one of said filler bodies and said paving structure formed against said depending side member.

12. The railroad track assembly of claim 11 wherein said retainer form is of an elastomeric material and said top member of said retainer form is narrower than said rail and said filler bodies together and is resiliently extensible in a transverse direction far enough to allow said retainer form to fit atop said rail with said side members resting against said respective outer faces of said filler bodies and thereby to urge said side members inwardly toward said filler bodies.

13. The railroad track assembly of claim 9, including a masonry blocking body located alongside one of said depending side members and removably attached to said retainer form.

14. A method of constructing a railroad track, comprising:

(a) placing a preformed elastomeric filler body alongside each of a pair of opposite sides of a rail;

(b) placing a retainer form having generally an inverted-U shape on said rail with a pair of sides of said retainer form urging said filler bodies toward the respective sides of said rail;

(c) placing paving materials alongside said rail and said retainer form and thereafter curing said materials to form a solid paving structure abutting said retainer form; and (d) removing said retainer form from said rail and leaving a slot alongside a portion of said elastomeric filler body on each of said opposite sides of said rail.

15. The method of claim 14, including the further step of providing a flush surface between said paving and structure said filler bodies by placing an elastomeric retainer body in each said slot.

16. The method of claim 14 wherein said step of placing paving materials alongside said rail and said retainer form includes the steps of attaching a blocking body to said retainer form, with a portion of said blocking body extending alongside a respective one of said sides of said retainer form and placing paving materials alongside said blocking body, allowing said paving materials to cure partially, removing said blocking body from said retainer form while said retainer form remains in place on said rail, and thereafter placing additional paving materials alongside said rail and against the respective side of said retainer form.

17. A method of constructing a railroad track, comprising:

(a) attaching a rail by fasteners atop a set of rail support bodies located on a foundation;

(b) placing a respective preformed filler body alongside each of a pair of opposite sides of said rail adjacent a head portion thereof;

(c) placing a protective cap over a portion of one of said rail support bodies with an upper margin of said cap resting against a respective one of said filler bodies so that said cap and said filler body cooperate to define a cavity above said portion of said rail support body; and (d) thereafter placing a quantity of castable paving material alongside said rail and said filler body and atop a portion of said protective cap while excluding said paving material from covering said fasteners.

18. The method of claim 17, including the further step of mounting an elongate seal on said foundation between said rail support bodies and extending longitudinally along said rail and extending upward to said filler body, and placing said paving material in contact with said seal to define a channel extending along and including said rail and said filler bodies.

19. The method of claim 18, including the step of placing an end closure member alongside said one of rail support bodies beneath an end of said protective cap before placing said quantity of castable paving material alongside said rail.

20. A method of constructing a railroad track, comprising:

(a) attaching a rail by fasteners atop a set of rail support bodies located on a foundation;

(b) placing a respective preformed filler body alongside each of a pair of opposite sides of said rail;

(c) thereafter placing a protective cap over a portion of one of said rail support bodies with an upper margin of said cap resting against a respective one of said filler bodies so as to define a cavity above said portion of said rail support body; and (d) thereafter placing a quantity of castable paving material alongside said rail and said filler body and atop a portion of said protective cap while excluding said paving material from covering said fasteners.

21. A method of constructing a railroad track, comprising:

(a) attaching a rail by fasteners atop a set of rail support bodies located on a foundation;

(b) placing a respective preformed filler body alongside each of a pair of opposite sides of said rail;

(c) placing a protective cap over a portion of one of said rail support bodies with an upper margin of said cap resting against a respective one of said filler bodies so as to define a cavity above said portion of said rail support body;

(d) thereafter placing a quantity of castable paving material alongside said rail and said filler body and atop a portion of said protective cap while excluding said paving material from covering said fasteners; and (e) mounting an elongate seal on said foundation between said rail support bodies and extending longitudinally along said rail and extending upward to said filler body, and placing said paving material in contact with said seal to define a channel extending along and including said rail and said filler bodies.

22. The method of claim 21, including the step of placing an end closure member alongside said one of rail support bodies beneath an end of said protective cap before placing said quantity of castable paving material alongside said rail.

23. A railroad track assembly, comprising:

(a) an elongate rail having a pair of opposite sides and including a base flange, a web extending upward from said base flange, and a head located atop said web;

(b) a pair of preformed elastomeric filler bodies each located closely alongside a respective one of said opposite sides of said rail;

(c) a paving structure located alongside one of said opposite sides of said rail at a predetermined distance therefrom and defining, cooperatively with a respective one of said filler bodies, a slot extending alongside said rail; and (d) a preformed retainer strip of resilient material including a wedge-shaped portion, said retainer strip filling said slot and urging said respective filler body tightly against said rail, said retainer strip and said filler body including mating locking structures which are mutually engaged when said retainer strip is located properly in said slot.

24. The railroad track assembly of claim 23 wherein said locking structures include a tongue located on said retainer strip and a groove located on said filler body to receive said tongue when said retainer strip is located properly in said slot.

* * * * *